US007963897B2

(12) United States Patent
Wang

(10) Patent No.: US 7,963,897 B2
(45) Date of Patent: Jun. 21, 2011

(54) RESISTANCE APPARATUS FOR A WAIST-TWISTING EXERCISER

(76) Inventor: Leao Wang, Taiping (TW)

( * ) Notice: Subject to any disclaimer, the term of this patent is extended or adjusted under 35 U.S.C. 154(b) by 43 days.

(21) Appl. No.: 12/371,913

(22) Filed: Feb. 17, 2009

(65) Prior Publication Data

US 2010/0210429 A1 Aug. 19, 2010

(51) Int. Cl.
*A63B 21/00* (2006.01)

(52) U.S. Cl. ..... 482/146; 482/147; 482/71

(58) Field of Classification Search ..... 482/146, 482/147, 71, 53, 54, 148
See application file for complete search history.

(56) References Cited

U.S. PATENT DOCUMENTS 2,906,532 A * 9/1959 Echols ..... 482/131
4,799,475 A * 1/1989 Iams et al. ..... 601/23
5,433,690 A * 7/1995 Gilman ..... 482/146

* cited by examiner

*Primary Examiner* — Jerome W Donnelly

(57) ABSTRACT

A resistance apparatus for a waist-twisting exerciser wherein the resistance apparatus includes a spring and an adjuster with a pulley block. The adjuster is mounted on a swing element while the spring is fixed at a proper position of the swing element such that the spring is correctly engaged into the pulley block of the adjuster. In applying force to the swing element in motion, the spring may be pulled to create an effective exercise resistance force for increasing the exercise effect. Moreover, the position of the adjuster is adjustable for changing the tension of the spring.

2 Claims, 5 Drawing Sheets

RESISTANCE APPARATUS FOR A WAIST-TWISTING EXERCISER

BACKGROUND OF THE INVENTION

1. Fields of the Invention

The invention relates to a resistance apparatus for a waist-twisting exerciser, and more particularly, to a structure for providing a proper exercise resistance.

2. Description of the Related Art

As we all know, the so-called "waist twist machine" is a fitness device by which the user may twist his waist and his abdominal muscles to achieve the unique exercise effect. At present, the conventional similar devices almost employ a rotating disc as a structural basis on which a user stands to apply force for its rotation. In use, the user has to hold a fixed handle with his both hands so that his upper body is positioned at a certain angle. At this point, the user twists the lower part of his body to the left and right side. In this way, the fitness exercise of the waist and the abdominal part is achieved.

The above-mentioned fitness device can be easily operated. Moreover, there is no special mechanical design. In taking the exercise effect into account, we find that the rotating disc does not provide a resisting force against the rotation thereof. Therefore, it is not possible for the operator to apply another force for increasing the exercise effect. Thus, the conventional device requires further improvements.

SUMMARY OF THE INVENTION

A primary object of the invention is to provide a resistance apparatus for a waist-twisting exerciser wherein the resistance apparatus is additionally provided to create an adjustable resistance force acting against the exercise force exerted by the operator. In this way, the exercise fitness effect and muscle-hardening effect are obviously improved.

According to the invention, the resistance apparatus includes a spring and an adjuster with a pulley block. The adjuster is mounted on a swing element while the spring is fixed at a proper position of the swing element such that the spring is correctly engaged into the pulley block of the adjuster. In applying force to the swing element in motion, the spring may be pulled to create an effective exercise resistance force for increasing the exercise effect. Moreover, the position of the adjuster is adjustable for changing the tension of the spring.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
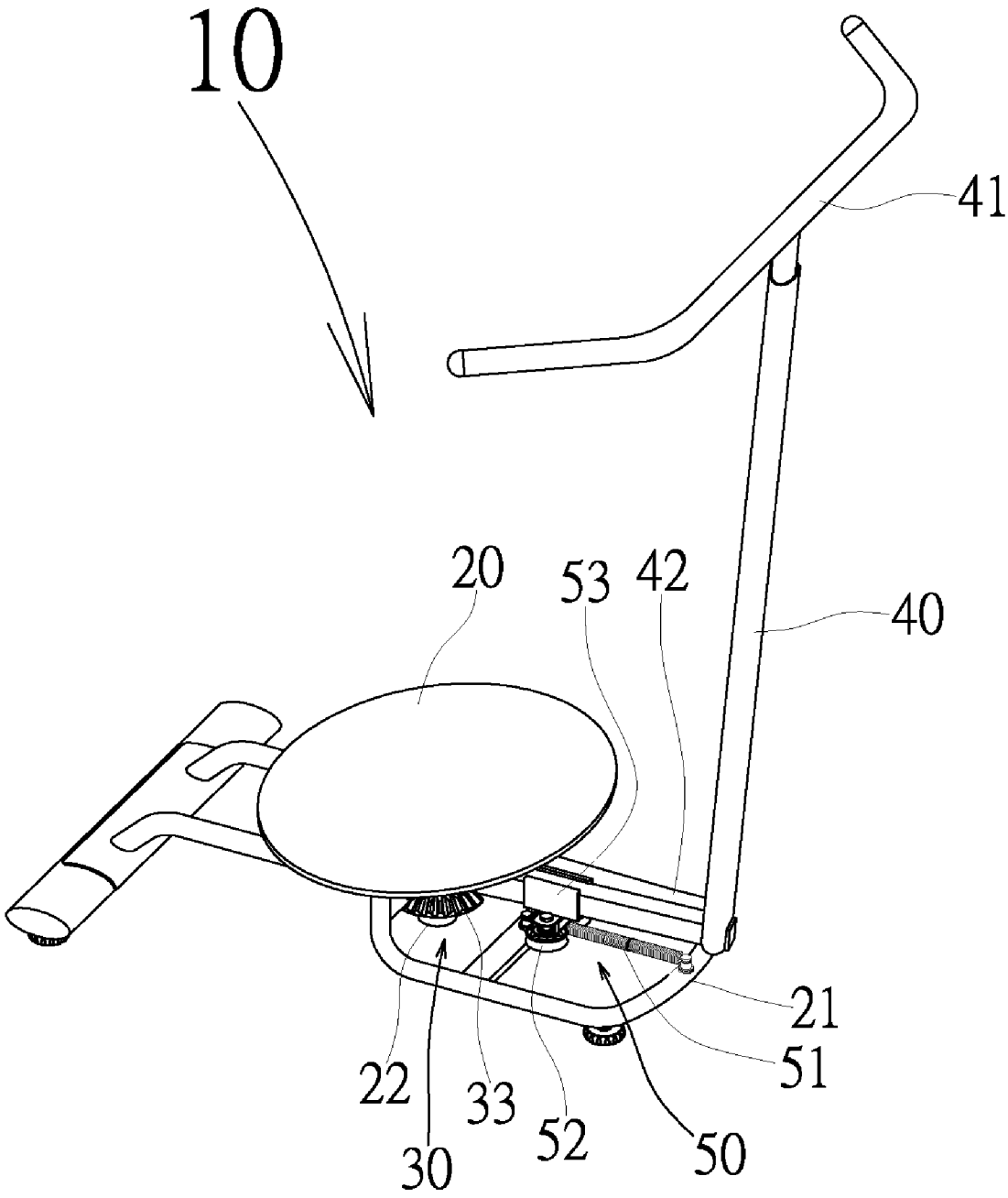
FIG. 1 is a perspective view of a preferred embodiment of the invention.
Figure 2:
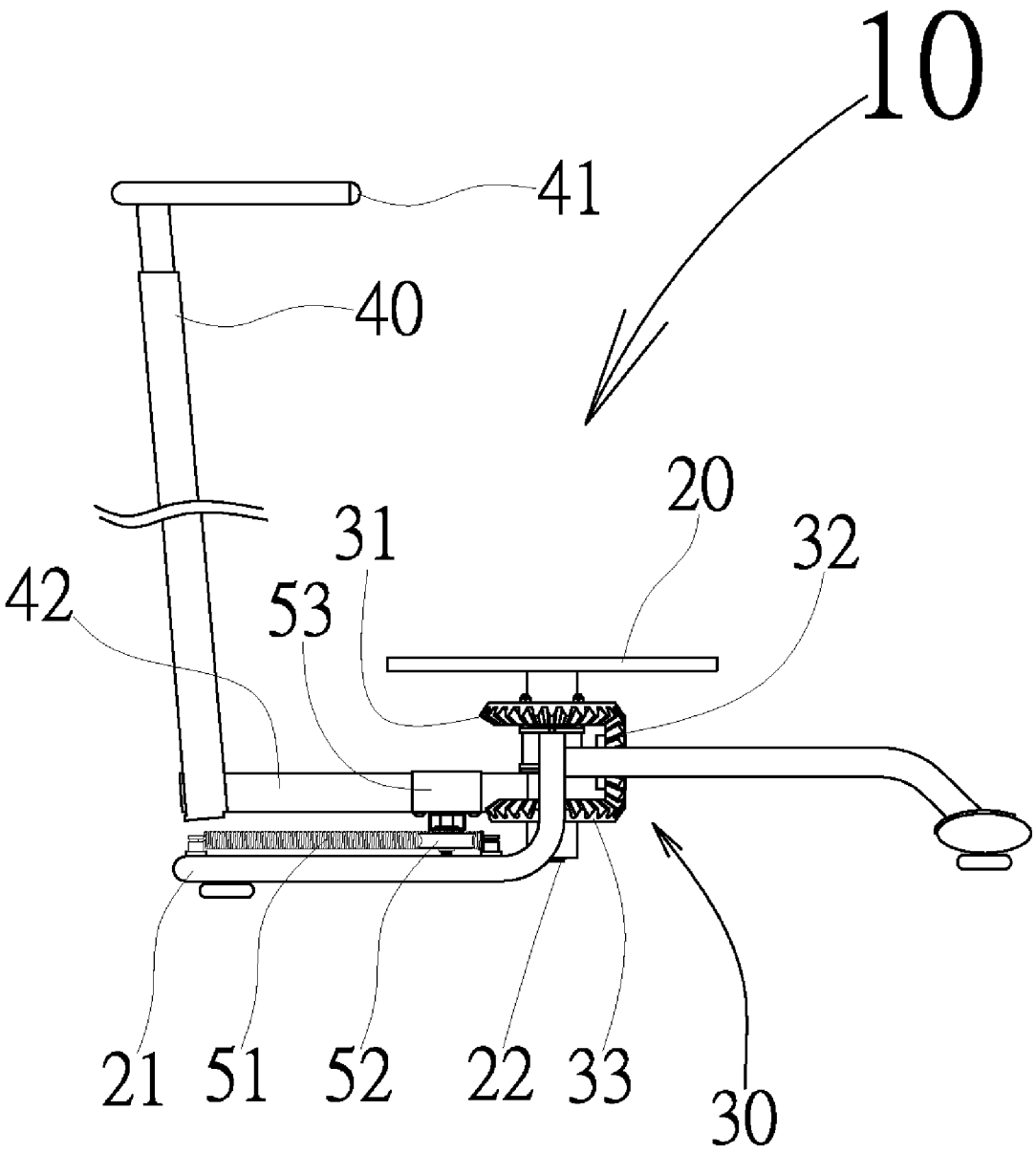
FIG. 2 is a side view of the preferred embodiment of the invention according to FIG. 1.
Figure 4:
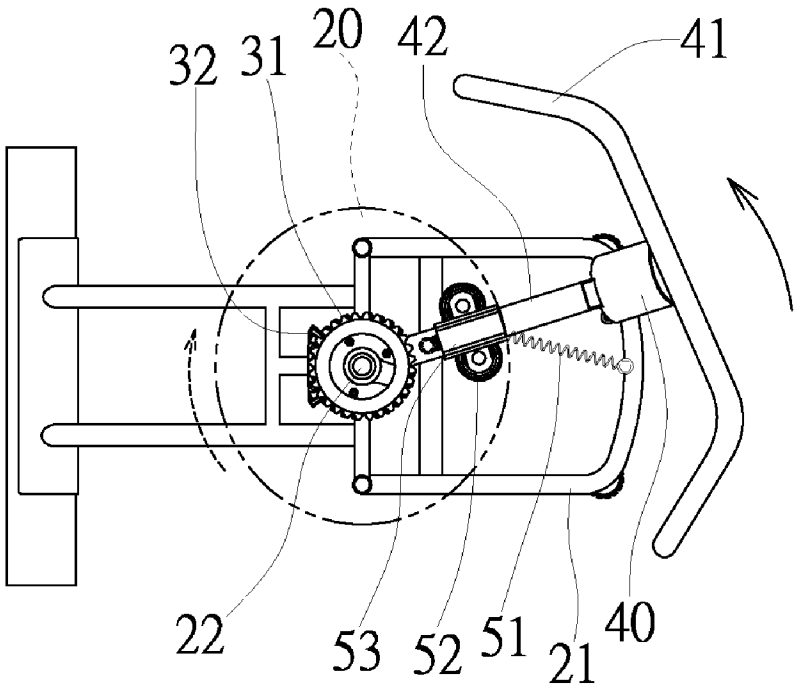
FIG. 4 is a top view of the operation according to FIG. 3.
Figure 3:
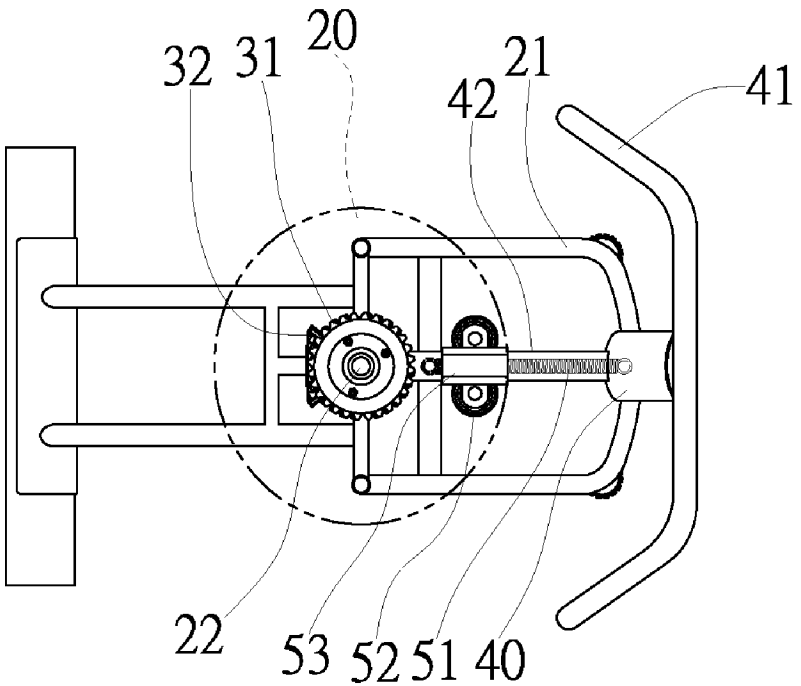
FIG. 3 is a top view of the preferred embodiment of the invention according to FIG. 1.

The present invention will now be described in more detail hereinafter with reference to the accompanying drawings that show various embodiments of the invention.

Referring to FIGS. 1 through 4, a resistance apparatus in accordance with the invention is applied to a waist-twisting exerciser 10. The waist-twisting exerciser 10 includes a rotating disc 20, a coupling mechanism 30, and a swiveling handlebar 40.

The rotating disc 20 is pivotally supported by a bottom base 21 and a supporting post 22 at the center thereof for the lower limb of an operator to stand thereon.

The coupling mechanism 30 is driven by the rotating disc 20. The coupling mechanism 30 includes a primary bevel gear 31 in lateral direction, an intermediate bevel gear 32 extended in longitudinal direction and engaged with the primary bevel gear 31, and a secondary bevel gear 33 engaged with the intermediate bevel gear 32.

The swiveling handlebar 40 includes a handlebar 41 at the top thereof for the upper limb of the operator to hold thereon. A handlebar transmission shaft 42 is attached to the bottom thereof and synchronically driven by the secondary bevel gear 33 in reverse rotation relative to the rotating disc 20.

Based on the assembly of the above-mentioned components, the swiveling handlebar 40 is synchronically swiveled in reverse direction when the rotating disc 20 is subject to a force in rotation. In this way, the upper and lower bodies of the operator may achieve an expected synchronically twisting effect. Likewise, the rotating disc 20 may be reversely and synchronically swiveled when the operator applies a force with his upper body to the handlebar 41 for a rotational motion.

In addition, a resistance apparatus 50 is interposed between the bottom base 21 and the handlebar transmission shaft 42. The resistance apparatus 50 includes a spring 51 and an adjuster 53 with a pulley block 52. The adjuster 53 is mounted on the handlebar transmission shaft 42 while the spring 51 is fixed at the bottom base 21 under the handlebar transmission shaft 42 such that the spring 51 is correctly engaged into the pulley block 52 of the adjuster 53. In applying force to the handlebar transmission shaft 42 for a swing motion to the right and right sides, the spring 51 may be pulled to create an effective exercise resistance force. Meanwhile, the adjuster 53 may be moved forward and backward to change the tension of the spring 51.

Figure 5:
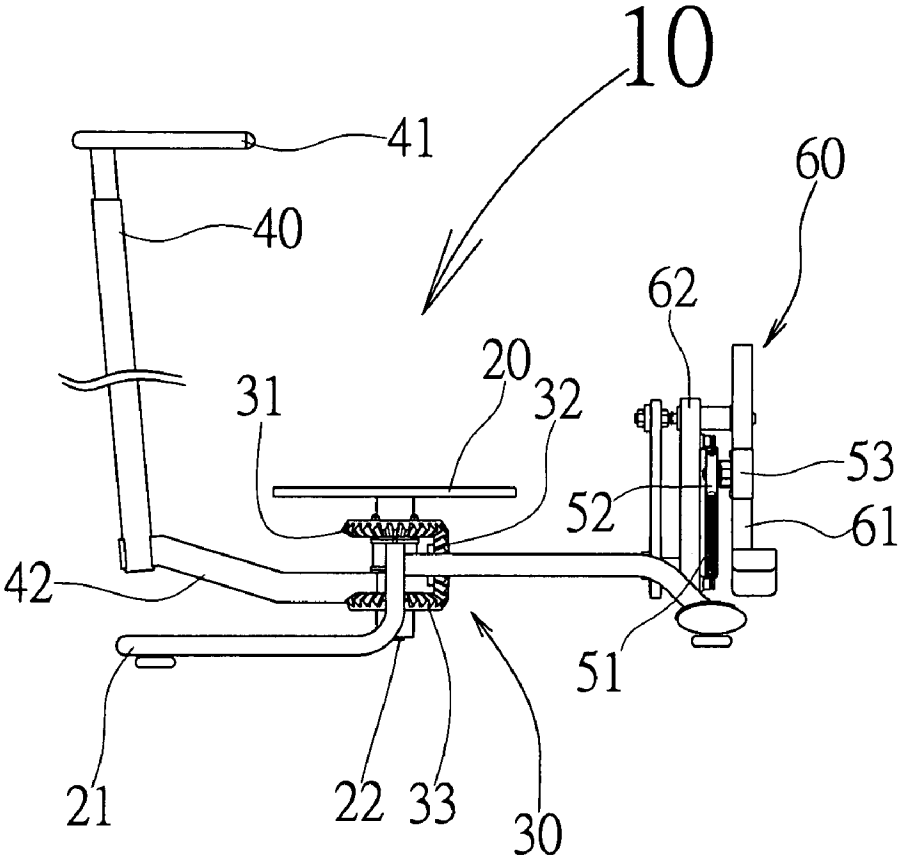
FIG. 5 is a side view of another embodiment of the invention.
Figure 7:
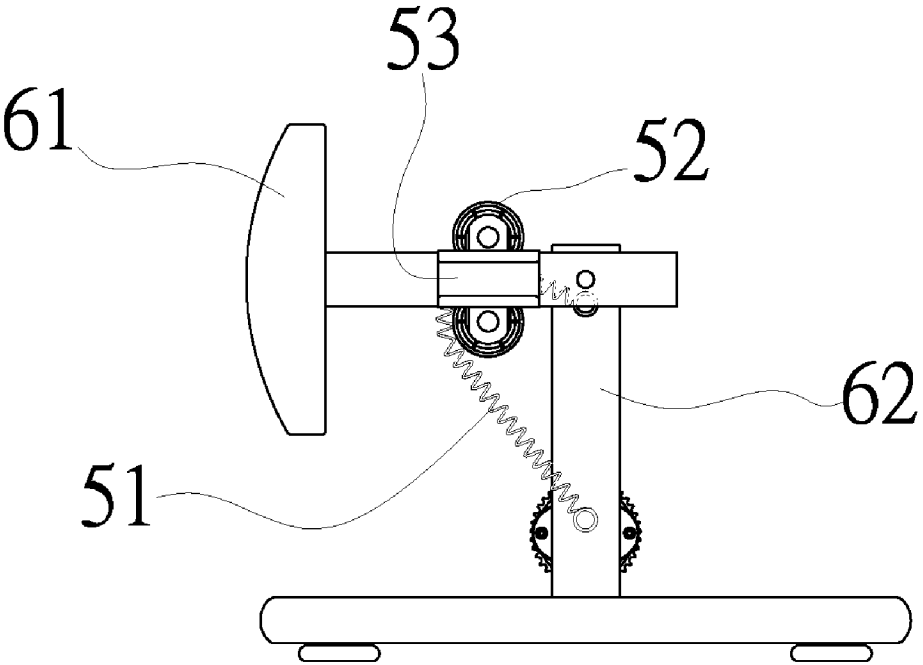
FIG. 7 is a top view of the operation according to FIG. 6.
Figure 6:
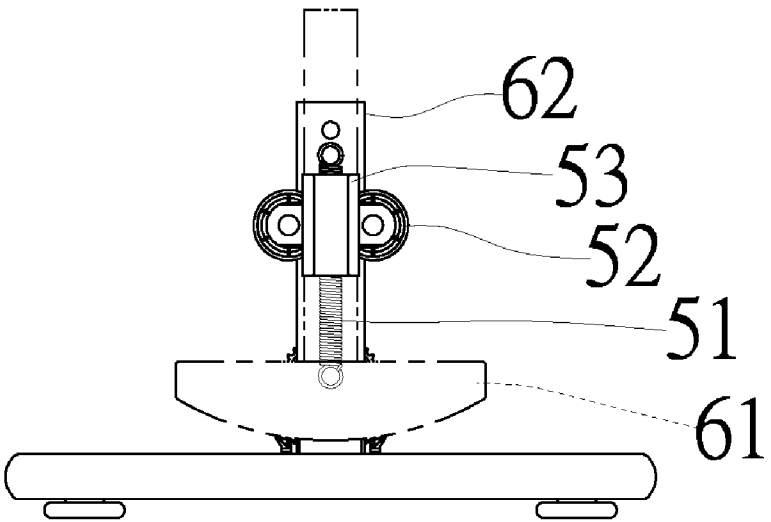
FIG. 6 is a partial view of the embodiment according to FIG. 5.

As shown in FIGS. 5 through 7, in which another embodiment of the invention is illustrated, the waist-twisting exerciser 10 also includes a rotating disc 20, a coupling assembly 30, and a swiveling handlebar 40. Besides, a pendulum mechanism 60 is coupled behind the intermediate bevel gear 32. As a result, the resistance apparatus 50 is interposed between a pendulum 61 and an upright support 62 of the pendulum mechanism 60. In this way, the same expected effect may be achieved as well.

The pendulum mechanism 60 has been disclosed by the applicant so that no further descriptions thereto are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A waist-twisting exerciser, the waist-twisting exerciser comprising:

a) a rotating disc pivotally configured to be supported by a bottom base and a supporting post at the center thereof for the lower limb of an operator to stand thereon;

b) a coupling mechanism driven by the rotating disc, the coupling mechanism having a primary bevel gear in lateral direction, an intermediate bevel gear extended in longitudinal direction and engaged with the primary bevel gear, and a secondary bevel gear engaged with the intermediate bevel gear; and c) a swiveling handlebar having a handlebar at the top thereof for the upper limb of the operator to hold thereon, an handlebar transmission shaft being attached to the bottom thereof and synchronically driven by the secondary bevel gear in reverse rotation relative to the rotating disc, wherein a resistance apparatus is interposed between the bottom base and the handlebar transmission shaft, and the resistance apparatus includes a spring and an adjuster with a pulley block, and wherein the adjuster is mounted on the handlebar transmission shaft while the spring is fixed at the bottom base under the handlebar transmission shaft such that the spring is correctly engaged into the pulley block of the adjuster, and wherein, in applying force to the handlebar transmission shaft for a swing motion to the right and right sides, the spring is configured to be pulled to create an effective exercise resistance force; wherein the adjuster is configured to be moved forward and backward to change the tension of the spring.

2. A waist-twisting exerciser, the waist-twisting exerciser comprising:

a) a rotating disc pivotally configured to be supported by a bottom base and a supporting post at the center thereof for the lower limb of an operator to stand thereon;

b) a coupling mechanism driven by the rotating disc, the coupling mechanism having a primary bevel gear in lateral direction, an intermediate bevel gear extended in longitudinal direction and engaged with the primary bevel gear, and a secondary bevel gear engaged with the intermediate bevel gear; and c) a swiveling handlebar having a handlebar at the top thereof for the upper limb of the operator to hold thereon, an handlebar transmission shaft being attached to the bottom thereof and synchronically driven by the secondary bevel gear in reverse rotation relative to the rotating disc, wherein a resistance apparatus is interposed between a pendulum of a pendulum mechanism and a upright support, and the resistance apparatus includes a spring and an adjuster with a pulley block, and wherein the adjuster is mounted on the pendulum while the spring is fixed at the upright support behind the pendulum such that the spring is correctly engaged into the pulley block of the adjuster, and wherein, in applying force to the pendulum for a swing motion to the right and right sides, the spring is configured to be pulled to create an effective exercise resistance force; wherein the adjuster is configured to be moved forward and backward to change the tension of the spring.

* * * * *